United States Patent [19]

Wolfe

[11] Patent Number: 4,812,265

[45] Date of Patent: Mar. 14, 1989

[54] CARBURETOR FUEL INLET VALVE

[75] Inventor: Michael J. Wolfe, Franklin County, Mo.

[73] Assignee: Tomco, Inc., St. Louis, Mo.

[21] Appl. No.: 130,986

[22] Filed: Dec. 10, 1987

[51] Int. Cl.[4] ..... B01F 3/04

[52] U.S. Cl. ..... 261/70; 137/444; 137/451

[58] Field of Search ..... 261/70; 137/444, 451; 29/157.1 R

[56] References Cited

U.S. PATENT DOCUMENTS

| | | | |
|---|---|---|---|
| 2,869,578 | 1/1959 | Crockett | 137/444 |
| 3,057,371 | 10/1962 | Stille | 137/451 |
| 3,334,649 | 8/1967 | Thompson | 261/70 |
| 3,365,166 | 1/1968 | Smith | 29/157.1 R |
| 3,454,036 | 7/1969 | Thompson | 261/70 |
| 3,593,400 | 7/1971 | Geiselman et al. | 29/157.1 R |
| 3,811,464 | 5/1974 | Eston | 137/444 |

*Primary Examiner*—Tim Miles

*Attorney, Agent, or Firm*—Polster, Polster and Lucchesi

[57] ABSTRACT

A preassembled carburetor valve of the general type shown and described in U.S. Pat. No. 3,454,036 has a floating disc-type valve without an encircling metal rim. The hollow body is provided with oppositely disposed "cathedral window" openings. The valve body, including the valve seat and the cathedral windows, is die cast.

4 Claims, 1 Drawing Sheet

CARBURETOR FUEL INLET VALVE

BACKGROUND OF THE INVENTION

This invention relates to improvements in valves for carburetors of the kind operated by a buoyant device or by a fluid pressure responsive member such as a piston or diaphragm and customarily installed in a carburetor for the purpose of maintaining a substantially constant fuel level as a fuel supply for the fuel metering devices in a carburetor. In particular, this invention has to do with an improved form of the valve shown and described in U.S. Pat. No. 3,454,036.

The valve shown and described in U.S. Pat. No. 3,454,036 has been in commercial production for many years. As the patent itself indicates, the valve disc has been caged in a metal rim. That is also true of the discs shown in U.S. Pat. No. 3,334,649. These valves have been formed on a screw machine, and have apertures drilled through flats on the hexagonal body, to form outlets or vents for passage of fluid.

One of the objects of this invention is to provide a carburetor fuel inlet valve that is at least as effective as the valve shown and described in U.S. Pat. No. 3,454,063, but is less expensive to produce.

Another object is to provide such a valve the body of which can be formed by die casting.

Other objects will become apparent to those skilled in the art in light of the following description and accompanying drawings.

STATEMENT OF THE INVENTION

In accordance with this invention, generally stated, a carburetor fuel inlet valve is provided which has all of the elements of the valve shown in FIGS. 1 and 2 of U.S. Pat. No. 3,454,063, but in its preferred form, has a one-piece, homogeneous, rimless, reversible plug valve member in the form of a disc positioned and dimensioned to move freely between a valve seat and an inner end of an actuator, two diametrically oppositely disposed cathedral windows through the side wall defining a chamber, and a body that is die cast in its entirety, including the chamber, valve seat, cathedral windows and threaded end.

DESCRIPTION OF THE PREFERRED EMBODIMENT

Figure 1:
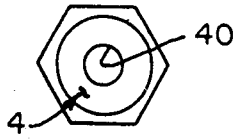
FIG. 1 is a top plan view of one illustrative embodiment of the valve of this invention.
Figure 2:
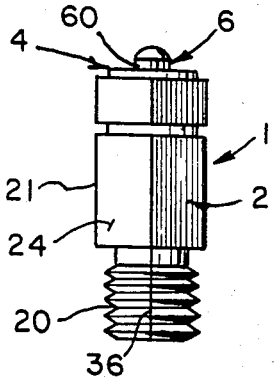
FIG. 2 is a view in side elevation.

Referring now to the drawing for one illustrative embodiment of carburetor fuel inlet valve of this invention, reference numeral 1 indicates a complete valve.

The valve 1 has a body 2, a closure 4, an actuator 6, and a valve disc member 8.

The body 2 has a threaded stem portion 20, a central section 21, and a hollow chamber 22, defined in part by a side wall 23. The side wall 23 has a hexagonal outer surface 24 and a cylindrical inner surface 25. A passage 26 extends through the lower end of the threaded stem 20 and, at an inner end of a reduced diameter section 27 of the passage, with the chamber 22. A truncated conical seat 28 surrounds the open mouth of the passage, and protrudes into the chamber 22.

Figure 3:
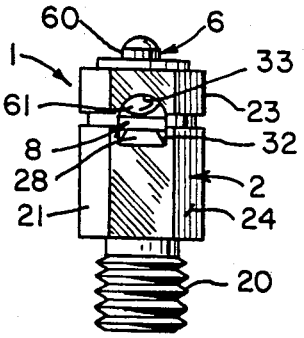
FIG. 3 is a view in side elevation at 90% from FIG. 2.
Figure 4:
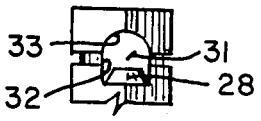
FIG. 4 is a fragmentary view in side elevation in the same orientation as FIG. 3, with a closure, actuator and valve disc removed.
Figure 5:
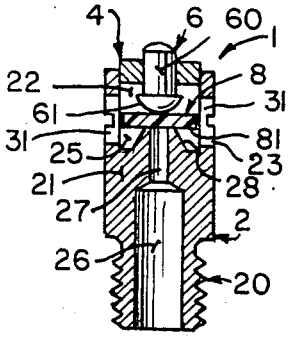
FIG. 5 is a longitudinal sectional view.
Figure 6:
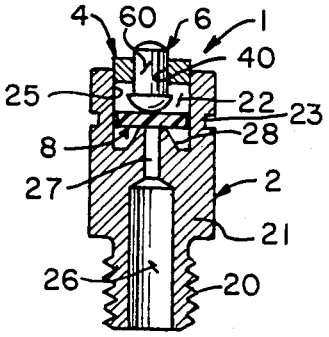
FIG. 6 is another longitudinal sectional view, taken at right angles to the view shown in FIG. 5.
Figure 7:
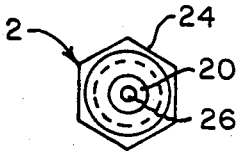
FIG. 7 is a bottom plan view.
Figure 8:
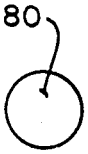
FIG. 8 is a top plan view of the valve disc.
Figure 9:
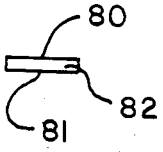
FIG. 9 is a view in side elevation of the valve disc shown in FIG. 8.

A pair of cathedral windows 31, with a rectangular lower part 32 and an arched upper part 33, are oppositely disposed diametrically with respect to the inner surface 25 of the side wall 23, and opening through parallel flats on the hexagonal outer surface 24, as shown in FIGS. 3 and 5.

The closure 4 has a central aperture 40, through which a stem 60 of the actuator 6 extends. At its inner end, the stem 60 has a hemispherical head 61. The lower surface of the hemispherical head 61 bears against an upper surface 80 of the disc 8. When the actuator is in fully raised position, an upper, annular surface of the head bears against the inner surface of the closure 4, which is press fit into the open top of the chamber 22 a distance that can be accurately gauged to limit the throw of the valve disc, as will be apparent. A lower surface 81 of the disc 8 is contiguous the valve seat 28. A peripheral edge 82 of the disc 8 is substantially perpendicular to the upper and lower surfaces 80 and 81. The disc is homogeneous, i.e. of uniform composition throughout, and has no rim of metal or other material around it.

The design of the valve body 2 is such as to permit die casting of the body, complete with the threaded stem, hollow chamber, valve seat and cathedral windows. The size, shape, and location of the cathedral windows permits simple coring. However, the size and shape of the windows also produces results superior to those of the conventional openings examplified by ones shown in U.S. Pat. No. 3,454,036. Those openings, which were drilled, had a total area of approximatelly 0.0491 square inches, with four holes. The total area of the cathedral windows is approximately 0.06 square inches, although the area utilized is about the same as that of the total area of the conventional four holes. The advantage lies in the fact that the cathedral windows permit the escape of larger bubbles, so that the fuel supply is not likely to be reduced by virtue of bubble blocking.

Inserts for the die from which the die casting is made, can be used to provide for different diameters and thread sizes and pitches. The die casting process produces a parting line 36, which, in practice, is barely visible and has no effect upon the use of the valve.

Numerous variations in the construction of the valve of this invention, within the scope of the appended claims, will occur to those skilled in the art in the light of the foregoing disclosure. Merely by way of illustration, the exterior shape of the body can be varied, for example to make it either round or differently polygonal. The hexagonal shape is convenient for installation with a hex wrench, but a cylindrical shape can be provided with a screw driver slot, or a square or octagonal shape can be installed with an open end wrench or the like. It may be desirable in some cases to have an odd number of sides to require a special tool to install or remove. The shape of the cathedral windows can be varied. However, the shape shown has the virtue of providing a smooth transition and a good release of pressure, whether by releasing gas, or an emulsion when the engine and carburetor are hot, but not to permit the disc 8 to hang up. At the same time, the size of the opening, coupled with the short throw required (in the neighborhood of 1/16 of an inch, less than 2 millimeters) permits the use of un-rimmed valve discs, which also reduces the expense of manufacture, and provides a disc with quick response because it is lighter in weight than the disc with the metal rim that has been used heretofore.

Having thus described the invention, what is claimed and desired to be secured by Letters Patent is:

1. In a carburetor fuel inlet valve having an elongated, two ended hollow valve body with an upper end and a lower end, a closure defining a top of a cylindrical chamber at said upper end, said closure being circular in plan and having a central aperture, a longitudinal passage in said valve body extending between the lower end of said body, oppposite said closure, and said chamber, a valve seat around an inner end of said passage protruding into said chamber between said passage end and said closure, and a valve actuator with a stem projecting through the aperture in said closure, the improvement comprising said housing chamber having a side wall with two, diametrically opposed cathedral windows through it spaced axially from said upper and lower ends, each with a rectangular lower part adjacent said lower end and an arched upper part adjacent said upper end.

2. The improvement of claim 1, including a one-piece homogeneous, rimless reversible plug member within said chamber positioned and dimensioned to move freely between said valve seat and an inner end of said actuator.

3. The improvement of claim 1 wherein said valve body has an externally threaded lower end through which said passage extends, and the entire body, including the chamber, valve seat, cathedral windows and threaded end, is die cast.

4. The improvement of claim 1 wherein said cathedral windows have a total area of the magnitude of 0.06 square inches.

* * * * *

UNITED STATES PATENT AND TRADEMARK OFFICE

CERTIFICATE OF CORRECTION

PATENT NO. : 4,812,265

DATED : March 14, 1989

INVENTOR(S) : Michael J. Wolfe and Robert F. Killion

It is certified that error appears in the above-identified patent and that said Letters Patent is hereby corrected as shown below:

Title page, left column, line 2 should read

[75] Inventors: Michael J. Wolfe, Franklin County, Mo. and Robert F. Killion, St. Louis County, Mo.

Signed and Sealed this

Sixth Day of February, 1990

*Attest:*

JEFFREY M. SAMUELS

*Attesting Officer*

*Acting Commissioner of Patents and Trademarks*